US010577841B2

(12) United States Patent
Bendel et al.

(10) Patent No.: US 10,577,841 B2
(45) Date of Patent: Mar. 3, 2020

(54) ELECTRIC MOTOR VEHICLE LOCK HAVING A SPRING ACCUMULATOR

(71) Applicant: Kiekert Aktiengesellschaft, Heiligenhaus (DE)

(72) Inventors: Thorsten Bendel, Oberhausen (DE); Michael Merget, Mettmann (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 685 days.

(21) Appl. No.: 14/914,698

(22) PCT Filed: Jul. 14, 2014

(86) PCT No.: PCT/DE2014/100251
§ 371 (c)(1),
(2) Date: Apr. 19, 2016

(87) PCT Pub. No.: WO2015/027983
PCT Pub. Date: Mar. 5, 2015

(65) Prior Publication Data

US 2016/0222704 A1 Aug. 4, 2016

(30) Foreign Application Priority Data

Aug. 29, 2013 (DE) ..... 10 2013 217 265

(51) Int. Cl.
*E05B 81/90* (2014.01)
*E05B 15/04* (2006.01)
(Continued)

(52) U.S. Cl.
CPC ..... *E05B 81/90* (2013.01); *E05B 15/002* (2013.01); *E05B 81/16* (2013.01); *E05B 2015/0496* (2013.01)

(58) Field of Classification Search
CPC ..... Y10T 292/1082; Y10T 70/7062; Y10T 70/8946; Y10T 292/0994; Y10T 292/1052;
(Continued)

(56) References Cited

U.S. PATENT DOCUMENTS 6,102,454 A 8/2000 Weyerstall
7,240,524 B1 * 7/2007 White ..... E05B 65/0021 292/144
(Continued)

FOREIGN PATENT DOCUMENTS

CN 101932782 A 12/2010
CN 102373844 A 3/2012
(Continued)

OTHER PUBLICATIONS

Machine Translation of DE10048709A1 by Lexis Nexis Total Patent on Apr. 7, 2016.
(Continued)

*Primary Examiner* — Mark A Williams
(74) *Attorney, Agent, or Firm* — Woodard, Emhardt, Henry, Reeves & Wagner, LLP

(57) ABSTRACT

The problem addressed by the invention is that of being to switch a motor vehicle lock from normal operation to emergency or disruption operation within an especially short time and/or with the least possible expenditure of electrical energy. This problem is solved in that a lock for a motor vehicle having a lock mechanism and an electric drive is provided such that the lock can be electrically opened in normal operation. The lock has an additional operating state, called disrupted operation. In disrupted operation, the lock can be opened mechanically, which is not possible in normal
(Continued)

operation. The lock comprises a mechanical energy accumulator for switching the lock from normal operation to disrupted operation.

21 Claims, 1 Drawing Sheet

(51) Int. Cl.
*E05B 81/16* (2014.01)
*E05B 15/00* (2006.01)

(58) Field of Classification Search
CPC . Y10T 70/5889; Y10T 70/7107; E05B 77/48; E05B 77/26; E05B 81/06; E05B 81/14; E05B 81/16; E05B 15/04; E05B 2015/0493; E05B 2047/0086; E05B 47/0003; E05B 81/90; Y10S 292/61; Y10S 292/23
See application file for complete search history.

(56) References Cited

U.S. PATENT DOCUMENTS

| | | | | |
|---|---|---|---|---|
| 8,727,398 | B2 | 5/2014 | Brose | |
| 8,960,736 | B2 * | 2/2015 | Graute | E05B 81/06 292/200 |
| 10,132,106 | B2 * | 11/2018 | Rosales | E05B 77/06 |
| 2006/0012185 | A1 * | 1/2006 | Kiehl | E05B 85/26 292/216 |
| 2006/0049642 | A1 * | 3/2006 | Dupont | E05B 83/36 292/216 |
| 2011/0084505 | A1 | 4/2011 | Brose et al. | |
| 2011/0259061 | A1 * | 10/2011 | Brose | E05B 81/06 70/237 |
| 2013/0333426 | A1 * | 12/2013 | Baker | E05B 47/0012 70/280 |
| 2019/0169889 | A1 * | 6/2019 | Beck | E05B 77/02 |

FOREIGN PATENT DOCUMENTS

| | | | |
|---|---|---|---|
| DE | 4218177 | A1 | 12/1993 |
| DE | 19849674 | A1 | 5/2000 |
| DE | 10048709 | A1 | 4/2002 |
| DE | 10064026 | | 5/2002 |
| DE | 102007003948 | A1 | 5/2008 |
| DE | 10 2008 018 500 | A1 | 4/2009 |
| DE | 102008018500 | A1 | 4/2009 |
| DE | 202010013611 | U1 | 2/2012 |

OTHER PUBLICATIONS

Machine Translation of DE102007003948A1 by Lexis Nexis Total Patent on Apr. 7, 2016.
Machine Translation of DE19849674A1 by Lexis Nexis Total Patent on Apr. 7, 2016.
Machine Translation of DE202010013611U1 by Lexis Nexis Total Patent on Apr. 7, 2016.
Machine Translation of DE4218177A1 by Lexis Nexis Total Patent on Apr. 7, 2016.
Chinese Office Action and partial translation Issued in related CN201480059226.7 dated Mar. 23, 2017.
German office action Issued in related DE102013217265.6 dated Mar. 5, 2014.
Machine translation of CN102373844A by Lexis Nexis Total Patent on Oct. 25, 2018 (pp. 29).
Machine translation of DE10054028 by Euoprean Patent Office Patent Translate, on Oct. 25, 2018 (pp. 15).

* cited by examiner

ELECTRIC MOTOR VEHICLE LOCK HAVING A SPRING ACCUMULATOR

BACKGROUND

The invention relates to a latch, in particular for a motor vehicle with a latch mechanism and with an electrical drive for electrical opening of the latch. A latch mechanism for a door or flap of a motor vehicle demonstrates a locking mechanism which comprises a catch and a pawl for the latching of the catch. The latch comprises a device which ensures first and foremost in an emergency or in the event of breakdown that the latch can be mechanically opened, i.e. without an electrical drive.

The latch initially mentioned serves for the temporary closure of openings in motor vehicles or buildings with the aid of doors or flaps. In the closed state of such a latch, the catch reaches around an in particular bracket-shaped locking bolt which is generally attached to the chassis in the case of a motor vehicle. If the catch reaches a closed position by means of pivoting effected with the aid of the locking bolt starting in an open position, the catch is ultimately locked into place by means of the pawl. A locking area of the pawl is then adjacent to a locking area of the catch, whereby the catch is prevented from being rotated back in the direction of the open position. The locking bolt can no longer leave the locking mechanism in the closed position.

For opening, it is necessary to move the pawl out of its locking position. If the pawl has been moved out of its locking position, the catch rotates in the direction of the open position. In the open position of the catch and thus in the open position of the locking mechanism, the locking bolt can leave the lock. The door or flap can thus be opened again.

There are latches with two different locking positions of the catch. The catch can then initially be latched into the pre-ratcheting position and finally into the so-called main ratcheting position by a further rotation in the closure direction. In the pre-ratcheting position a locking bolt can no longer leave the locking mechanism. However, a relevant door or flap is not yet completely closed. Such a door or flap is only completely closed when the catch is rotated to the main ratcheting position and latched into place here. A second pawl can be provided for latching into place in the pre-ratcheting position.

The latch can comprise a blocking lever which is capable of blocking a pawl if the pawl latches the catch into place. In order to open such a locking mechanism, the blocking lever must first be moved out of its blocking position.

In order to open a latch with particular ease, in the locked state the catch is able to initiate an opening torque into the pawl. The opening torque can cause the pawl to be moved out of its latching position. Such a latch prevents undesirable movement by a blocking lever. If the blocking lever is moved out of its blocking position, the latch then opens automatically. Such a state of the art is known from the publication DE 10 2007 003 948 A1.

There is an activation device to open a latch. The locking mechanism opens when the activation device is activated. A door handle or a flap can be part of the activation device. This handle is generally connected to an activation lever of the latch via a rod or a Bowden cable. If the handle is activated, the activation lever of the latch is pivoted by means of the rod or Bowden cable in such a way that the latch opens. A motor vehicle normally has an external handle which can be accessed from outside, and/or an internal handle which can be accessed from inside.

In accordance with the publication DE 100 48 709 A1 in normal operation the known latch cannot be opened by activation of an external handle, because in normal operation a necessary connection between an activation lever and the locking mechanism is absent. The latch can only be opened from the outside in normal operation with the aid of an electrical drive. However, in an emergency or breakdown the electrical drive makes the mechanical connection between the handle and the locking mechanism in order then to be able to open the latch mechanically in the event of an emergency by activation of the external handle. An emergency is present, for example, in the event of an accident. If a sensor indicates the presence of an emergency, the electrical drive produces the mechanical connection within 10 ms. Such contemporary latches are capable of shifting a latch within 20 ms, such that it can subsequently be opened mechanically.

An airbag sensor can act as a sensor. If an airbag sensor indicates an accident, several milliseconds (ms) of electrical energy are generally available following the signal in order that the mechanical connection can be made by the electrical drive. The electrical energy supply can then fail.

A further sensor can monitor the charging state of a motor vehicle battery. If the charging state of the battery falls below a certain threshold value, this defect can be indicated by the sensor in order to ensure that the electrical drive makes the mechanical connection in order to subsequently enable mechanical opening.

SUMMARY

Insofar as not stated otherwise hereinafter, the latch in accordance with the invention described below can demonstrate the aforementioned characteristics individually or in any combination.

The task of the invention is to further develop a latch of the initially stated type. In particular, the present invention strives towards being able to shift a latch from normal operation to emergency or breakdown operation within an especially short time and/or with the least possible consumption of electrical energy.

In order to solve the task, a latch comprises the characteristics of the first claim. Advantageous designs arise from the sub claims.

For the solution, a latch in particular for a motor vehicle is provided with a latch mechanism and with an electrical drive which opens the latch electrically in normal operation. The latch has a further operating state which is hereinafter referred to as breakdown operation. In breakdown operation a mechanical opening of the latch is possible which is not possible in normal operation. The latch comprises a mechanical energy storage device to shift the latch from normal operation to breakdown operation. This is understood to mean an energy storage device, the mechanically stored energy of which can be used to shift the latch from normal operation to breakdown operation.

The latch in accordance with the claim makes it possible to use mechanically stored energy in the case of breakdown or emergency in order to open the latch mechanically following the release of the mechanically stored energy which is not possible in normal operation. Following mechanical activation, for example activation of an external handle of a door or flap, these doors or flap can be opened in breakdown operation without requiring electrical energy. The electrical energy requirements for such a shift from normal operation to breakdown operation are especially low.

An example of a mechanical energy storage device is a compressed air storage device. If the latch is shifted from normal operation to breakdown operation, the compressed air storage device is opened. The gas escaping under pressure is then used to couple an activation lever with a pawl in the manner known from publication DE 100 48 709 A1, for example. The compressed air escaping is then used to move the intermediate lever known from publication DE 100 48 709 A1 from a non-coupling position to a coupling position. For example, a fixed piston can be released which is then moved as a result of the excess pressure in the compressed air storage device. The movement of the piston can be used directly or indirectly in order to enable mechanical activation of the latch, i.e. a shift to breakdown operation. A movement of the intermediate lever known from the publication DE 100 48 709 A1 into its coupling position requires a relatively great amount of time and energy compared to the case of opening of a compressed air storage device, for example release of a fixed piston of the compressed air storage device. Using a mechanical energy storage device results in savings of time and energy consumed in order to move a latch from normal operation to breakdown operation.

The use of a flywheel is possible in order to provide mechanically stored energy to shift from normal operation to breakdown operation.

In one design, the latch encompasses an electrical control which can control the release of the energy stored in the mechanical energy storage device. This design enables recognition of the occurrence of a breakdown within the shortest time with the aid of an electrical or electronic sensor and initiation of the shift to breakdown operation. Electrical energy is then no longer required for actual shifting. It then no longer depends whether electrical energy is available for an electrical shift.

In one design, the electrical control encompasses an electromagnet which magnetically holds a coupling component in its non-coupling position. If no electrical energy or insufficient electrical energy is available, the magnetic force ceases to apply which is able to hold the coupling component in its non-coupling position. For example, with a pre-tensioned spring, for example with a pre-tensioned spiral spring, the coupling component is then moved into its coupling position which enables the latch to be mechanically opened. In this design form, no electrical energy needs to be available for several milliseconds in order to be able to mechanically open a door or a flap in case of a breakdown causing an outage of the electrical power supply.

In a technically simple execution form of the invention a spring, such as the spiral spring, is used as a mechanical storage device, for example. This is pre-tensioned in order to store mechanical energy. A mechanical energy storage device can thus be provided with little installation space in a technically simple manner which is especially insusceptible to breakdown.

In a technically simple design, an arm spring is used as spring from which, for example, a spring arm moves during closure of the door and thus enters a storage position.

In order to store the spring energy, in one execution form a pin is used which releases a pre-tensioned arm of the spring for shifting to breakdown operation. Consequently, using the energy stored in the spring there is a possibility of mechanically activating the larch. However, such a movable pin can also fix a piston of a compressed air storage device in normal operation. By moving the pin the piston is released to shift over to breakdown operation.

In one design the pin proceeds in a linear fashion or is rotated to release the mechanically stored energy.

Advantageously, a rotational movement of the pin around its longitudinal axis is sufficient to release the mechanically stored energy. As a result, time and energy can be further reduced in order to release the mechanical energy stored in the mechanical energy storage device for a shift from normal operation to breakdown operation.

In a further advantageous execution variant of the invention, the pin demonstrates a bevel or step for a release of the mechanically stored energy. Dependent on the position of the bevel or step, mechanically stored energy is released. A long end of the bevel or step fixes a pre-tensioned arm of a spring. Consequently, after rotation of the cylinder pin the short side of the cylinder pin releases the spring. In contrast to known systems, the pin can be rotated in very short periods. Consequently, the energy of the spring is directly available. It is thus possible that less than 5 ms of electrical energy needs to be provided in order subsequently with the aid of the mechanically stored energy to move the latch into a state which enables mechanical activation.

Preferably the electrical drive with which the latch can be activated can be controlled by the control in such a way that the electrical drive is able to release the mechanically stored energy. The electrical drive is therefore normally used to electrically activate the latch in such a way that the door or flap can subsequently be opened. Furthermore, the electrical drive is used in order to put the place the latch into a state which permits mechanical activation. For example, in one execution form the electrical drive moves the aforementioned pin in order to release the mechanical energy stored by the movement of the pin.

In one advantageous execution form of the invention the mechanical energy storage device can be charged up by closure of a door or flap. In the case of a spring, a spring is therefore pre-tensioned by the closure of a door or flap. In the case of a compressed air storage device, for example, a piston is moved in such a way that gas pressure is built up as a result. This execution form, which enables recharging of a mechanical energy storage device by closure of a door or flap ensures that a mechanical energy storage device can be or is reliably recharged and at least if the mechanical energy storage device has previously emitted mechanically stored energy for any reasons, i.e. has been emptied.

The latch is preferably formed in such a way that a pertaining door of flap can only be mechanically opened from outside in breakdown operation. In one design, the door or flap can be mechanically opened from inside. In another design, the door or flap can only be mechanically opened from inside in breakdown operation.

In one design, the latch can additionally also be shifted from normal operation to breakdown operation by means of an electrical drive, thus for example in the manner known from publication DE 100 48 709 A1. If in an emergency or breakdown situation a sufficient amount of electrical energy is available for a sufficient period, the shift from normal operation to breakdown operation can be executed directly by an electrical drive erfolgen. Der mechanische Energiespeicher ergänzt dann das Umstellen, wäre ober nicht für das Umstellen zwingend erforderlich.

The invention enables in particular the pre-tensioning of a spring during the closure process of a side door or flap which is released in the case of a relevantly high voltage drop of the vehicle battery or in the case of accident in order that the mechanically stored energy is available in order to place the latch into a state which enables mechanical activation. This considerably reduces reaction times whilst minimizing the risk of insufficient power supply being available. The known 20 milliseconds can thus be reduced to times of less than 5 milliseconds.

The following are shown:

DETAILED DESCRIPTION OF THE DRAWINGS

Figure 1:
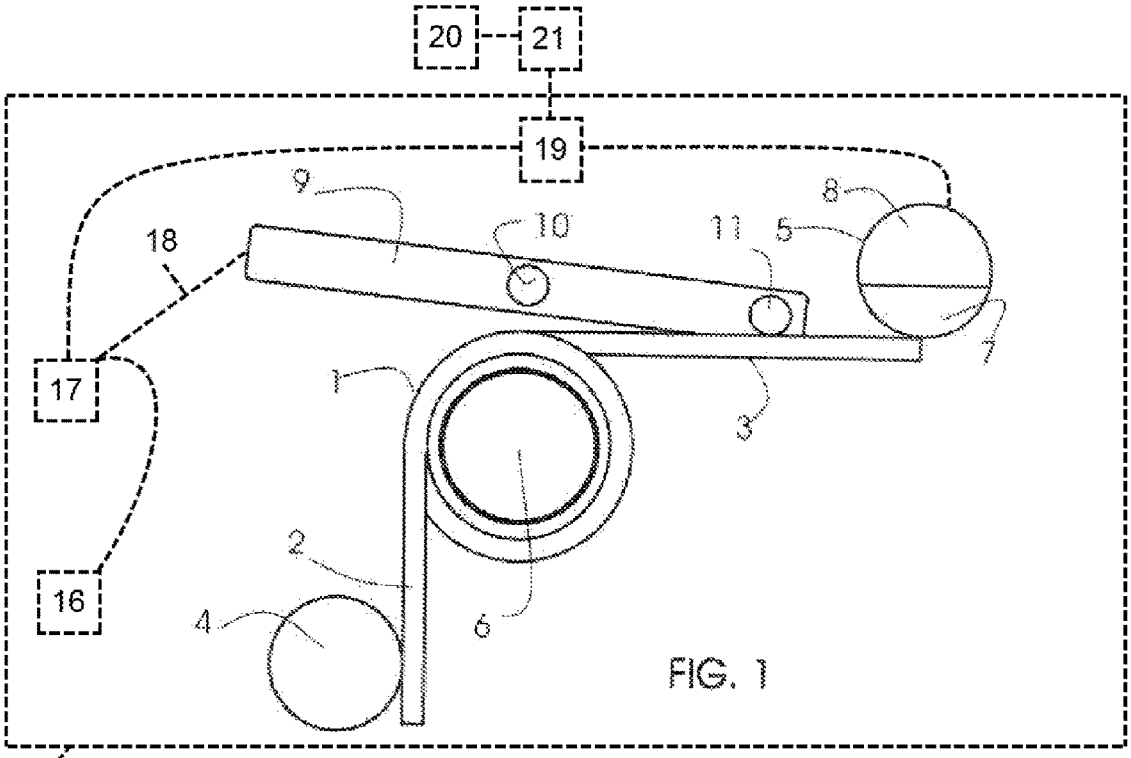
FIG. 1: Mechanical energy storage device in the charged up state.

FIG. 1 shows a door 15 which contains a mechanical energy storage device of a latch 17, with which the latch 17 can be shifted from normal operation to breakdown operation. The mechanical energy storage device comprises a pre-tensioned arm spring 1 with two arms 2 and 3. One arm 2 lies adjacent to a bolt 4 in a pre-tensioned manner. The other arm 3 lies adjacent to a pin 5 in a pre-tensioned manner. Furthermore, the spring 1 is held by an axle 6. The pin 5 demonstrates a step-shaped end with a higher step 7 and a lower step 8. In the charged state of the mechanical energy storage device, the arm 3 of the spring 1 is adjacent to the higher step 8.

Figure 3:
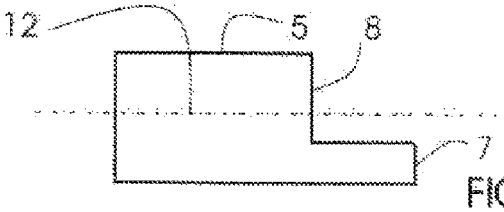
FIG. 3: Cut by a pin with a step-shaped end.

FIG. 1 also shows a lever 9 which can be rotated around its axis 10. Lever 9 is operationally coupled to latch 17 by intermediate lever 18. One end of the lever 9 demonstrates a protruding bolt 11 which is adjacent on the arm 3 of the spring 1. The pin 5 can be rotated around its longitudinal axis 12 shown in profile in FIG. 3.

Figure 2:
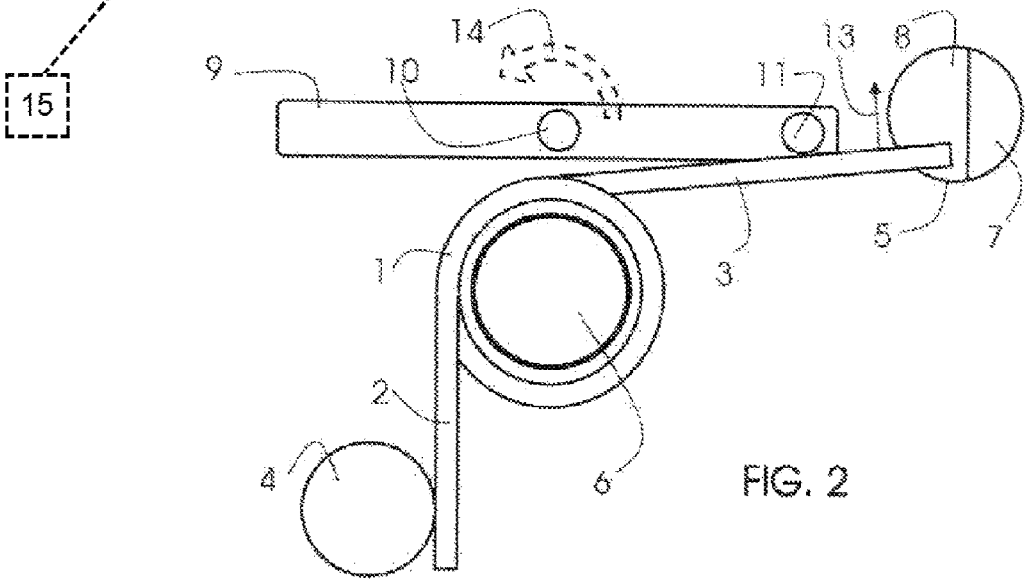
FIG. 2: Mechanical energy storage device during emission of mechanically stored energy.

If the pin 5 is rotated from the position shown in FIG. 1 around its longitudinal axis by motor 19, so that it assumes the position shown in FIG. 2, the arm 3 of the spring 1 is no longer adjacent to the higher step 7. Electronic controller 21 controls operation of motor 19 if sensor 20 indicates an emergency. The arm 3 now moves via the lower step 8 in the direction of the arrow 13. Thus, the lever 9 is rotated around its axis 10 in accordance with the arrow direction 14. This movement of the lever means that the latch 17 can subsequently be mechanically opened in a way, such as by activation lever 16, which was not previously possible.

REFERENCE SIGN LIST

1: Arm spring
2: Arm of the arm spring
3: Arm of the arm spring
4: Bolts
5: Rotatable pin
6: Axis
7: Higher step
8: Lower step
9: Activation lever
10: Axis of the rotatable lever
11: Bolts protruding from the lever
12: Longitudinal axis of the pin
13: Direction of the arrow
14: Direction of the arrow
15: Door
16: Handle
17: Latch
18: Intermediate lever
19: Motor
20: Electronic sensor
21: Electronic controller

The invention claimed is:

1. An assembly for use with a latch for a door or a flap of a motor vehicle, the latch having a closed state in which the latch retains a locking bolt and an open state in which the latch does not retain the locking bolt, the latch comprising an electrical drive and an activation lever, wherein the latch has two different operating states, a first operating state, a normal operation state, in which the latch can be electrically opened with the electric drive, and a second operating state, a breakdown operation state, in which the latch can be mechanically opened by manual activation of an external handle of the door or flap which moves the activation lever and opens the latch, wherein, in breakdown operation, the activation lever is moved without the electrical drive, the assembly comprising:

a mechanical energy storage device, and a movable body operatively connected to the latch, wherein the mechanical energy storage device is arranged to selectively move the movable body, wherein moving the movable body shifts the latch from the normal operation state to the breakdown operation state, wherein the mechanical energy storage device is configured to move the movable body and shift the latch from the normal operation state to the breakdown operation state in the event that the motor vehicle is in an accident.

2. The assembly in accordance with claim 1, further comprising an electrical control which controls the release of the energy stored in the mechanical energy storage device.

3. The assembly in accordance with claim 1, wherein the mechanical energy storage device comprises a spring.

4. The assembly in accordance with claim 3, wherein the mechanical energy storage device further comprises a movable pin which is adapted to release the energy stored in the mechanical energy storage device by means of movement moving the movable pin.

5. The assembly in accordance with claim 4, wherein the pin is adapted to release the energy stored in the mechanical energy storage device by moans of rotation rotating around its longitudinal axis.

6. The assembly in accordance with claim 5, wherein one end of the pin comprises a step adapted to release the energy stored in the mechanical energy storage device when the pin is rotated.

7. The assembly in accordance with claim 6, wherein the electrical drive, with which the latch can be electrically opened in normal operation, is adapted to rotate the pin to shift the latch from the normal operation to the breakdown operation.

8. The assembly in accordance with claim 1, further comprising an electrical control, wherein the electrical control controls the electrical drive to release the energy stored in the mechanical energy storage device.

9. The assembly in accordance with claim 1, wherein the movable body is a rotatable lever.

10. The assembly in accordance with claim 9, further comprising an intermediate lever adapted to functionally couple the rotatable lever with the latch to move the latch from the normal operation to the breakdown operation upon release of the mechanically stored energy.

11. The assembly in accordance with claim 1, wherein the mechanical energy storage device is adapted to be charged by opening the door or the flap.

12. The assembly in accordance with claim 1, wherein, absent the mechanical energy storage device moving the latch from the normal operation to the breakdown operation, a door or flap of the motor vehicle cannot be mechanically opened from outside the motor vehicle.

13. The assembly in accordance with claim 1, wherein the mechanical energy storage device comprises an arm spring.

14. The assembly in accordance with claim 1, wherein the mechanical energy storage device further comprises a movable pin which is adapted to release the energy stored in the mechanical energy storage device by moving the movable pin.

15. The assembly in accordance with claim 14, wherein the electrical drive is adapted to move the pin to shift the latch from the normal operation state to the breakdown operation state.

16. The assembly in accordance with claim 7, wherein the electrical drive is configured to move the pin to shift the latch from the normal operation state to the breakdown operation state in less than 5 ms.

17. The assembly in accordance with claim 7, wherein the activation lever is positioned outside the motor vehicle and wherein, absent the mechanical energy storage device moving the latch from the normal operation state to the breakdown operation state, a door or flap of the motor vehicle cannot be mechanically opened from outside the motor vehicle.

18. The assembly in accordance with claim 1, wherein the electrical control is configured to release the mechanical energy storage device to shift the latch from the normal operation state to the breakdown operation state in less than 5 ms.

19. The assembly in accordance with claim 1, further comprising:

a sensor adapted to detect when the motor vehicle is in an accident, and an electrical control operatively coupled to the sensor and the mechanical energy storage device, wherein, upon the sensor detecting the accident, the electrical controller releases the mechanical energy storage device to move the latch from the normal operation to the breakdown operation.

20. An assembly for a motor vehicle with a latch and an activation lever, the latch having a closed state in which the latch retains a locking bolt and an open state in which the latch does not retain the locking bolt, wherein the latch has two different operating states, a normal operation state in which the latch can be electrically opened and the activation lever cannot open the latch, and a breakdown operation state in which the latch can be mechanically opened by the activation lever, the assembly comprising:

a movable body that is operatively connected to the latch and configured to shift the latch from the normal operation state to the breakdown operation state, a spring that biases the movable body toward shifting the latch from the normal operation state to the breakdown operation state, a movable pin having a first position where the movable pin restrains the movable body from shifting the latch from the normal operation state to the breakdown operation state and a second position where the movable pin does not restrain the movable body from shifting the latch from the normal operation state to the breakdown operation state, a sensor adapted to detect when the motor vehicle is in an accident, an electric drive adapted to move the movable pin from the first position to the second position, and an electrical control operatively coupled to the sensor and the electric drive, wherein, upon the sensor detecting the accident, the electric drive moves the movable pin from the first position to the second position thereby releasing the movable body to move the latch from the normal operation state to the breakdown operation state.

21. The assembly of claim 20, wherein the movable body is a rotatable lever.

* * * * *